US007360285B2

(12) United States Patent
Takazawa

(10) Patent No.: US 7,360,285 B2
(45) Date of Patent: Apr. 22, 2008

(54) AUTOMATIC SLIDER FOR A SLIDE FASTENER

(75) Inventor: Shigeyoshi Takazawa, Runcorn (GB)

(73) Assignee: YKK Corporation, Tokyo (JP)

( * ) Notice: Subject to any disclaimer, the term of this patent is extended or adjusted under 35 U.S.C. 154(b) by 145 days.

(21) Appl. No.: 11/119,851

(22) Filed: May 2, 2005

(65) Prior Publication Data

US 2005/0246872 A1 Nov. 10, 2005

(30) Foreign Application Priority Data

May 4, 2004 (GB) ..... 0409928.9

(51) Int. Cl.
*A44B 19/30* (2006.01)

(52) U.S. Cl. ..... 24/423; 24/424; 24/420; 24/421

(58) Field of Classification Search ..... 24/415, 24/418–425, 429–432, 436
See application file for complete search history.

(56) References Cited

U.S. PATENT DOCUMENTS

| | | | | |
|---|---|---|---|---|
| 2,277,503 | A * | 3/1942 | Pickens | 24/421 |
| 5,611,121 | A * | 3/1997 | Akeno et al. | 24/423 |
| 6,499,200 | B1 * | 12/2002 | Yamagishi et al. | 24/429 |
| 2002/0108218 | A1 * | 8/2002 | Chen | 24/431 |

FOREIGN PATENT DOCUMENTS

EP 0 743 024 11/1996

* cited by examiner

*Primary Examiner*—Jack W. Lavinder
(74) *Attorney, Agent, or Firm*—Alston & Bird LLP

(57) ABSTRACT

An automatic lock slider 1 for a concealed slide fastener comprises a slider body 3, a locking lever 5 and a knob 11. The locking lever 5 is pivotally mounted on the slider body 3. A locking pawl 53 on one end 55 of the locking lever 5 is urged into a fastener element guide channel 39 of the slider body 3 by a spring 7, to prevent unintentional sliding of the slider 1 along a slide fastener. The knob 11 is attached to a connecting ring 9 through which the locking lever 5 is inserted. When opening or closing the slide fastener, the knob 11 rocks and lifts the locking lever 11 to withdraw the locking pawl 53 from the fastener element guide channel 39, thereby allowing movement of the slider 1 along the slide fastener.

20 Claims, 5 Drawing Sheets

AUTOMATIC SLIDER FOR A SLIDE FASTENER

CROSS-REFERENCE TO RELATED APPLICATIONS

The entire disclosure of United Kingdome patent application number 0409928.9 filed on May 4, 2004 is incorporated herein by reference in its entirety.

BACKGROUND OF THE INVENTION

1. Field of the Invention

This invention relates to an automatic lock slider for a slide fastener, in which a decorative part is attached to a slider body as a knob, instead of a hanging pull tab.

2. Description of the Related Art

When a slide fastener forms part of an item of clothing or other fashion accessory, the aesthetic impact of a slider or slide fastener should be carefully considered. This has led to the development of concealed slide fasteners which are hidden from view in normal operation, and decorative parts which can be attached to the pull tab of the slider to enhance the aesthetic appeal of the product. Alternatively, the pull tab may be replaced by a decorative knob for practical or aesthetic reasons. For example, if the slider is fixed to an item which experiences sudden movement, the pull tab would move to and fro, which may cause audible or physical irritation to a wearer of a garment bearing such a slider.

In our application published as EP-A-0 743 024 we disclosed an automatic slider for a concealed slide fastener, the slider comprising a pivotally mounted locking lever which is spring loaded to engage with elements of a slide fastener to resist sliding of the slider, a pivotally mounted release member arranged to release the locking lever from a locked position and a knob attached to the release member to facilitate movement of the release member and the slider. When a force is applied to the knob to move the slider to close a slide fastener, the knob is lifted to release the locking member to allow movement of the slider along the slide fastener. However, when a force is applied to the knob to move the slider in the opposite direction, i.e. to open the slide fastener, the locking member does not automatically disengage from the elements of the slide fastener. In order to disengage the locking member the knob must be lifted upwards and simultaneously moved in the appropriate direction along the slide fastener. This combined sliding and lifting is an awkward manoeuvre which can be a hindrance to efficient operation of the slide fastener.

To increase the aesthetic potential of a slide fastener, decorative parts should be interchangeable to allow decorative parts of different designs to be used on the slider. The knob of EP-A-0 743 024 is attached to the slider body by means of a tube on the knob which slides over a plug bearing peripheral ledges so that the ledges are brought into close contact with the curved portions of the tube. To change the knob, the knob is pulled upwards which may damage the tube, the plug or the ledges.

Therefore, it is an aim of the present invention to provide a slider for a slide fastener, the slider being moved by means of a decorative knob which is interchangeable by a user with knobs of different designs.

It is a further aim of the present invention to provide an automatic slider for a slide fastener, the slider being propelled by means of a decorative knob such that when the knob is moved along a slide fastener in either direction the locking mechanism on the slider automatically disengages from the slide fastener.

SUMMARY

According to a first aspect of the invention there is provided an automatic lock slider for a slide fastener, the slider comprising: a slider body having a fastener element guide channel; a locking lever pivotally mounted on the slider body, the locking lever having a locking pawl at one end; resilient means urging the locking pawl into the fastener element guide channel; a connecting ring, a portion of which is disposed between the slider body and the locking lever; and a knob mounted on the connecting ring, wherein when the knob is pulled in a first direction a first portion of the knob bears on the slider body so that the connecting ring withdraws the locking pawl from the fastener element guide channel and when the knob is pulled in a second direction a second portion of the knob bears on the slider body so that the connecting ring withdraws the locking pawl from the fastener element guide channel.

Preferably the first portion of the knob and the second portion of the knob are on an underside of the knob.

Preferably the knob is mounted on the connecting ring at a third portion of the underside of the knob and the first portion of the underside of the knob and the second portion of the underside of the knob are disposed on opposing sides of the third portion of the underside of the knob.

Preferably the knob is pivotally mounted on the locking lever.

Preferably the slider body comprises a guide post on which the locking lever is mounted.

Preferably the knob comprises a slot and a bore which passes through the slot, the slot for receiving the connecting ring and the bore for receiving a locking pin to lock the knob to the connecting ring.

Preferably the locking pin is removable. Preferably the locking pin is made of a resilient material.

Preferably the resilient means is a spring.

According to a second aspect of the invention there is provided a slider comprising: a slider body; a connecting ring mounted on the slider body; and a knob mounted on the connecting ring, the knob having a slot and a bore which passes through the slot, the slot for receiving the connecting ring and the bore for receiving a locking pin to lock the knob to the connecting ring.

Preferably the locking pin is removable. Preferably the locking pin is made of a resilient material.

According to a third aspect of the invention there is provided an automatic lock slider comprising: a slider body; a locking lever pivotally mounted on the slider body, the locking lever having a lug; and a knob mounted on the lug of the locking lever, wherein the knob is fixed to the lug.

According to a fourth aspect of the invention there is provided a slider comprising: a slider body having a fastener element guide post; and a knob mounted on the slider body, wherein the knob comprises a cavity to accommodate a portion of the fastener element guide post of the slider body, thereby preventing sideways movement and twisting of the knob relative to the slider body.

Preferably the cavity is defined between two downwardly extending side walls.

Preferably the cavity is further defined by a third downwardly extending wall which connects the two side walls.

DESCRIPTION OF THE DRAWINGS

Embodiments of the invention will now be described, by way of example, with reference to the accompanying drawings in which.

DETAILED DESCRIPTION OF THE INVENTION

Figure 1:
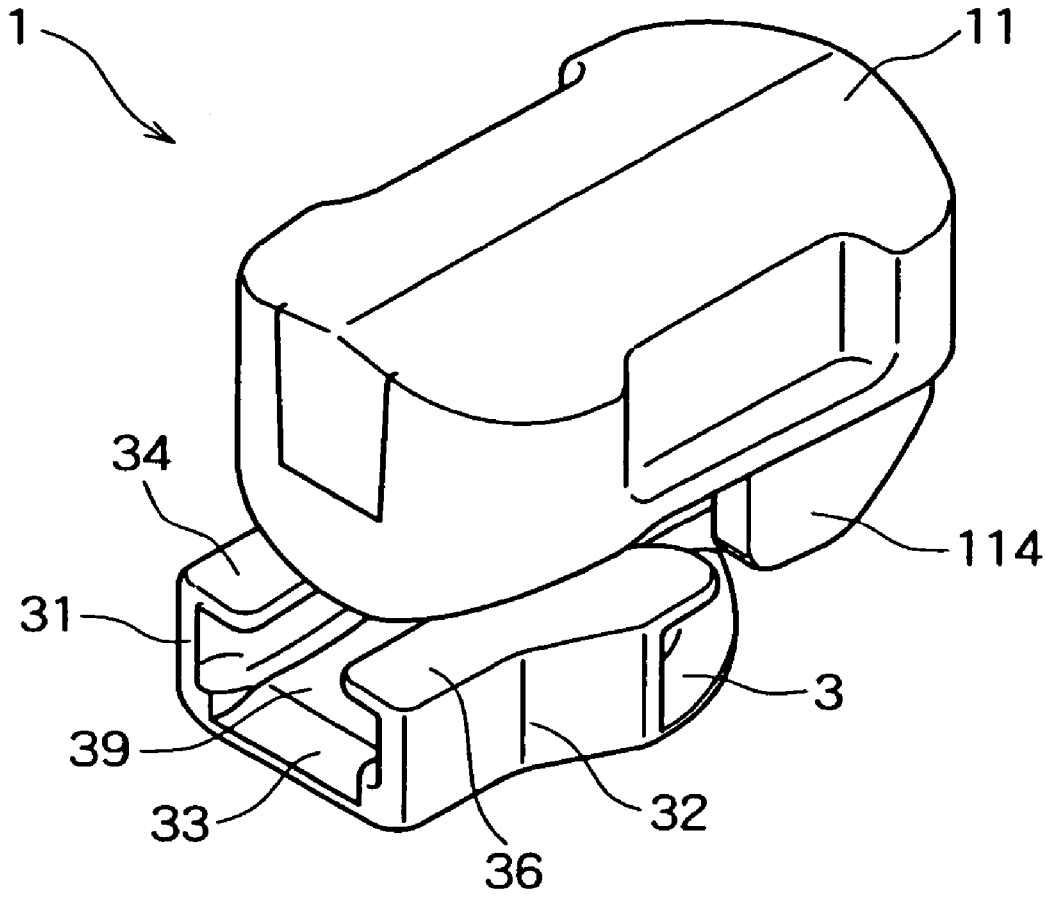
FIG. 1 is a perspective view of an automatic lock slider according to the present invention.
Figure 2:
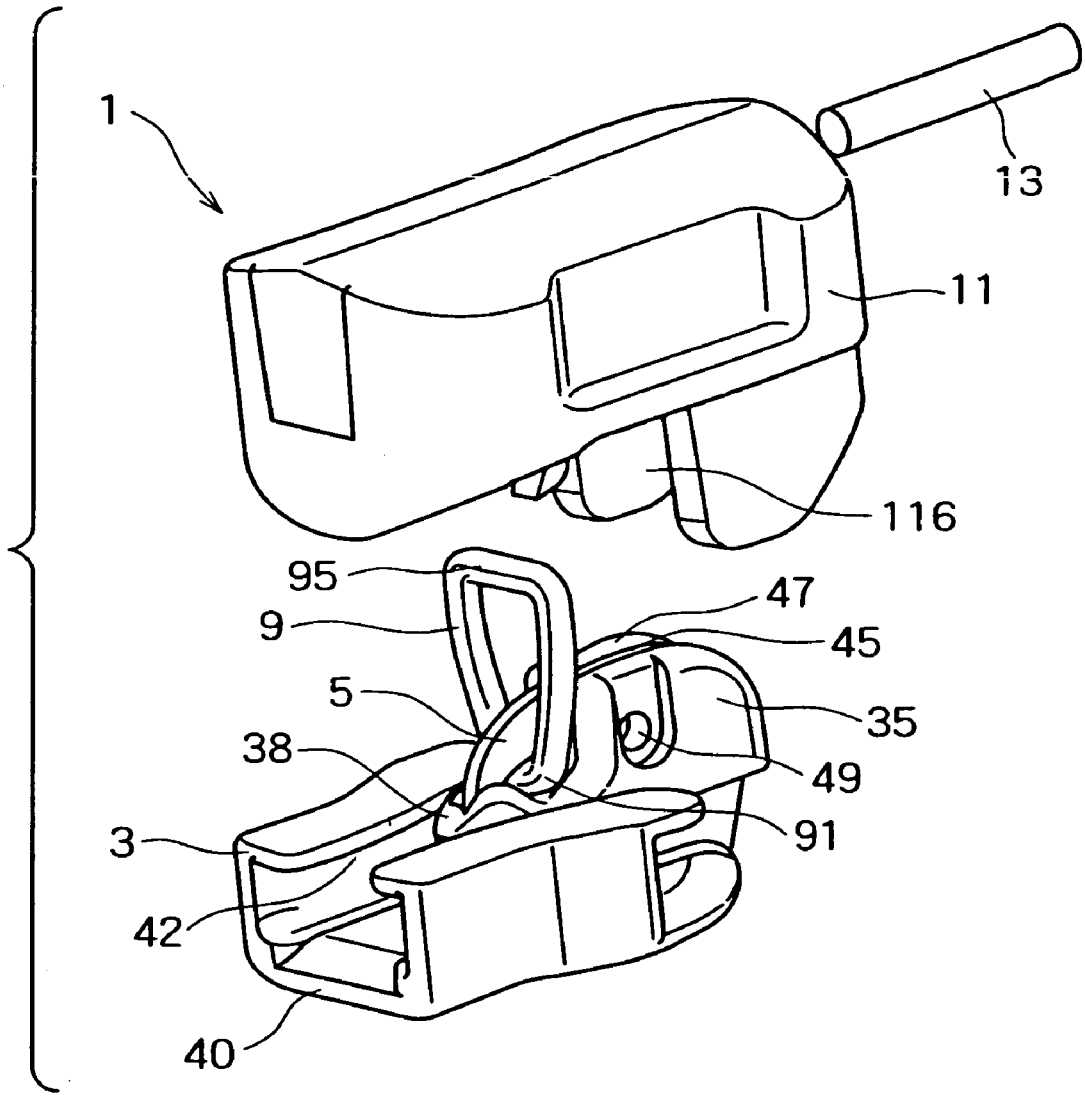
FIG. 2 is an exploded view of the slider of FIG. 1.
Figure 3:
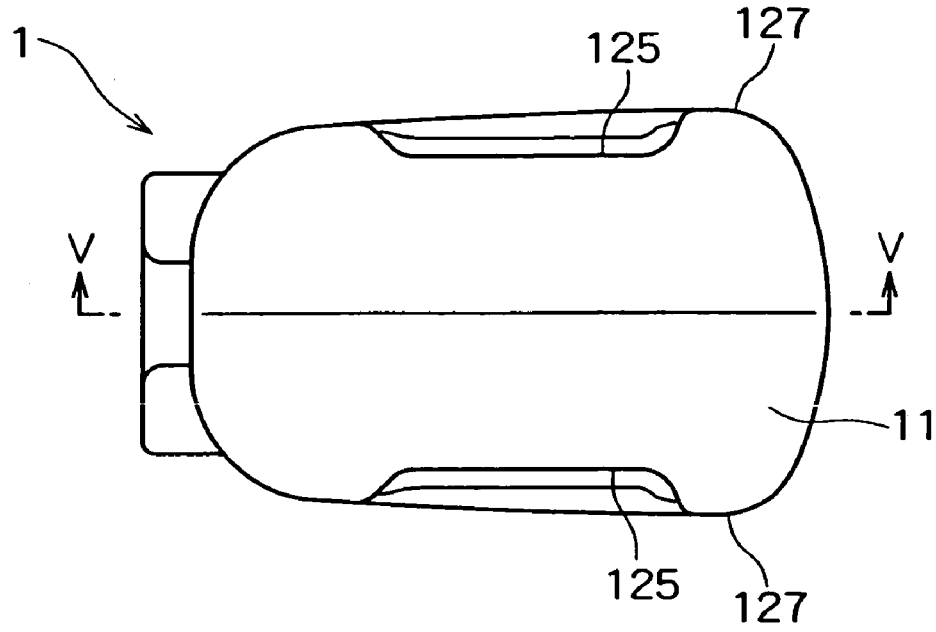
FIG. 3 is a top view of the slider of FIG. 1.

Referring to FIGS. 1 to 5, a slider 1 for a concealed slide fastener comprises a slider body 3, a locking lever 5, a spring 7, a connecting ring 9, a knob 11 and a locking pin 13.

The slider body 3 is comprised of a lower wing 33, side walls 31, 32 extending upwards from opposing edges of the lower wing 33, flanges 34, 36 extending inwards from the upper edges of the side walls 31, 32 and a fastener element guide post 35 standing on a front end 37 of the lower wing 33 so as to define a Y-shaped fastener element guide channel 39 between the side walls 31, 32 and the fastener element guide post 35. The guide post 35 extends upwards beyond the flanges 34, 36. A protrusion 38 on the guide post extends towards the back end 40 of the slider to define a Y-shaped opening 42 between the flanges 34, 36 and the fastener element guide post 35, which accommodates in use the tape of a concealed slide fastener. There is a pawl insertion hole 41 in the protrusion 38. There is an axially extending slot 45 in the top 47 of the guide post 35 in which the locking lever 5 is located. An aperture 49 passes through both sides of this portion of the guide post 35, to allow pivotal mounting of the locking lever 5 on the slider body 3, as is described below.

A cylindrical recess 71 in the guide post 35 houses a spring 7. In its uncompressed state, the spring 7 is longer than the cylindrical recess 71.

The locking lever 5 has a locking pawl 53 extending at a right angle at one end 55 and a flat portion 57 at the other end. The locking pawl 53 has an arcuate retaining portion 59 which is inserted through the connecting ring 9. A rivet 51 or the like passes through the aperture 49 in the slider body 3 and an aperture 61 in a centre portion 63 of the locking lever 5 to pivotally mount the locking lever 5 on the slider body 3. The spring 7 bears on the flat portion 57 of the locking lever 5 to urge the locking pawl 53 through the pawl insertion hole 41 into the fastener element guide channel 39. In this embodiment the spring 7 is a helical spring, but other resilient means may be deployed.

The connecting ring 9 has a generally triangular shape having a first apex 91 which is hooked under the arcuate retaining portion 59 of the locking lever 5. The side 95 of the connecting ring 9 opposite the first apex 91 fits into a transverse slot 111 in the knob 11, as is explained below.

Figure 6:
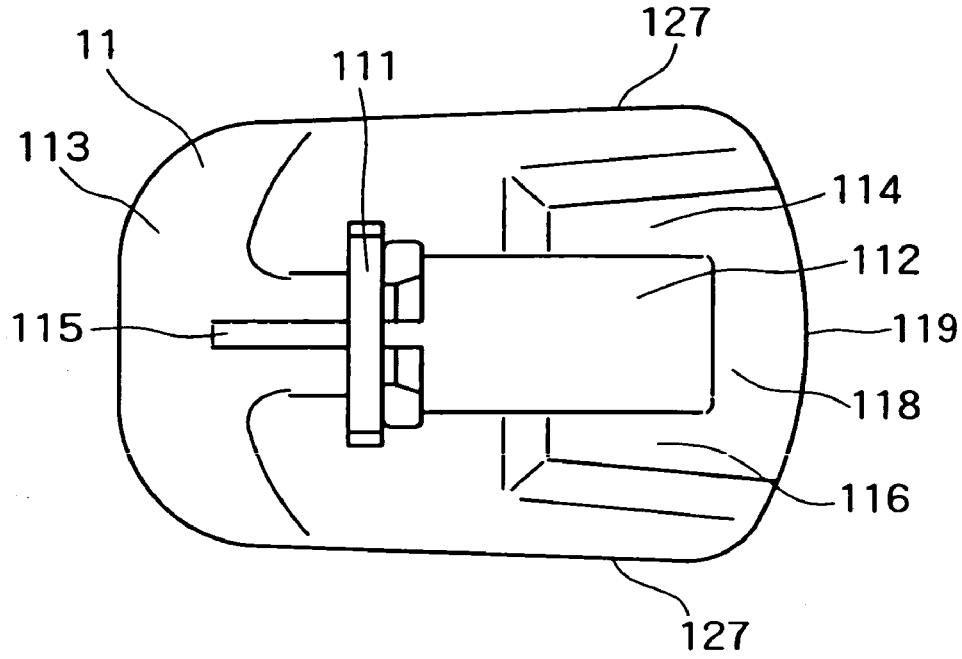
FIG. 6 is a view of the underside of a knob of the slider of FIG. 1.

FIG. 6 is a view of the underside 113 of the knob 11. There is a longitudinal slot 115 which accommodates the locking lever 5, a transverse slot 111 which accommodates the connecting ring 9 and a cavity 112 which accommodates the upper portion of the guide post 35 of the slider body 3. The cavity 112 is defined by two downwardly extending side walls 114, 116 which are connected by a downwardly extending front wall 118. The side walls 114, 116 of the cavity 112 inhibit sideways movement and twisting of the knob 11 relative to the slider body 3. There are curved indents 125 on either side 127 of the knob 11, providing a convenient pinch point when the knob 11 is gripped between two fingers.

Figure 5:
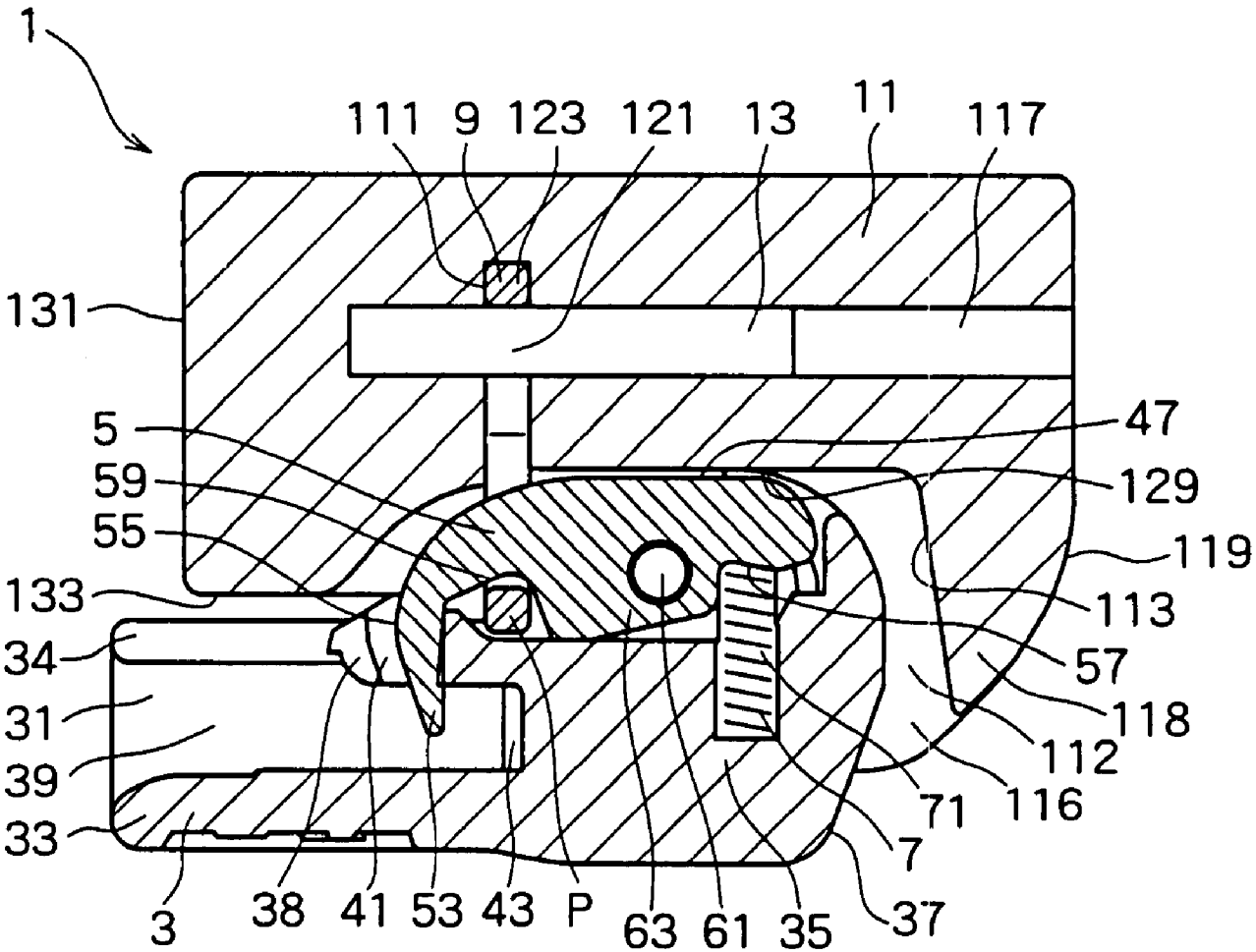
FIG. 5 is a section through plane V-V of FIG. 1.

Referring to FIG. 5, a bore 117 extends from the front end 119 of the knob 11 to intersect the transverse slot 111. The position of the area of intersection 121 of the bore 117 and the transverse slot 111 is such that the portion 123 of the transverse slot 111 above the area of intersection 121 is able to accommodate the side 95 of the connecting ring 9 opposite the first apex 91.

To assemble the slider 1, the spring 7 is inserted into the cylindrical recess 71 in the guide post 35 of the slider body 3. A connecting ring 9 is looped over the arcuate retaining portion 59 of the locking lever 5 and the locking lever is placed into the slot 45 in the slider body 3, slightly compressing the spring 7. A rivet 51 is passed through the aperture 49 in one side of the slider body 3, the aperture 61 in the locking lever 5 and the aperture 49 in the other side of the slider body 3, and the rivet 51 is fixed in place.

The knob 11 is placed over the slider body 3 so that the connecting ring 9 fits into the transverse slot 111 of the knob 11 and a locking pin 13 is inserted into the bore 117 to pass through the connecting ring 9 to lock the knob 11 to the connecting ring 9. The locking pin 13 may be made of a solid rod or a resilient slotted tube may be used. In this manner, the knob 11 is pivotally mounted on the locking lever 5 about a pivot point P which generally coincides with the axis of the first apex 91 of the connecting ring 9.

Figure 4:
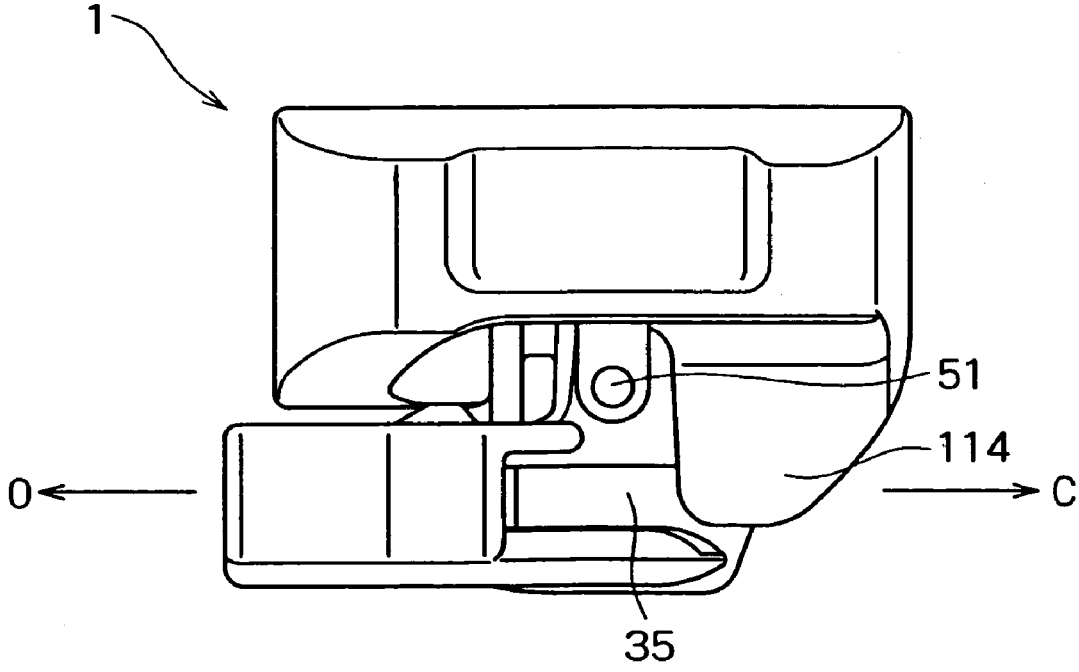
FIG. 4 is a side view of the slider of FIG. 1.

In operation, the slider 1 is fitted to a slide fastener and is slidable along the slide fastener. In this embodiment, the slider 1 is designed for a concealed slide fastener, but the slider 1 can be adapted for use on a standard non-concealed type slide fastener. Referring to FIG. 4, to close the slide fastener, the slider 1 is moved forward in the direction of the arrow C and to open the slide fastener, the slider 1 is moved backwards in the direction of the arrow O.

When the slider 1 is at rest, the locking pawl 53 of the locking lever 5 is urged by the spring 7 into the fastener element guide channel 39 to engage with a fastener element of a slide fastener, thereby preventing movement of the slider 1. Before the slider 1 can be moved, the locking pawl 53 must be withdrawn from the fastener element guide channel 39, by rotating the locking lever 5 against the force of the spring 7. This is achieved by movement of the knob 11, which is pivotally mounted on the locking lever 5.

To close the slide fastener, the knob 11 is gripped between a finger and thumb and is moved in the general direction of arrow C. The knob 11 rotates clockwise in FIG. 5 about the pivot point P so that the front end 119 of the knob 11 moves towards the slider body 3. A first portion 129 of the underside 113 of the knob 11 comes into contact with the top 47 of the guide post 35 of the slider body 3 and further rotation of the knob 11 causes the connecting ring 9 to rotate the locking lever 5 against the force of the spring 7 so that the locking pawl 53 withdraws from the fastener element guide channel 39, allowing the slider 1 to move along the slide fastener to close the slide fastener.

To open the slide fastener, the knob 11 is gripped between a finger and thumb and is moved in the general direction of arrow O. The knob 11 rotates anti-clockwise in FIG. 5 about the pivot point P so that the back end 131 of the knob 11 moves towards the slider body 3. A second end portion 133 of the underside 113 of the knob 1I comes into contact with the slider body 3 and further rotation of the knob 11 causes the connecting ring 9 to rotate the locking lever 5 against the force of the spring 7 so that the locking pawl 53 withdraws from the fastener element guide channel 39, allowing the slider 1 to move along the slide fastener to open the slide fastener.

Figure 7:
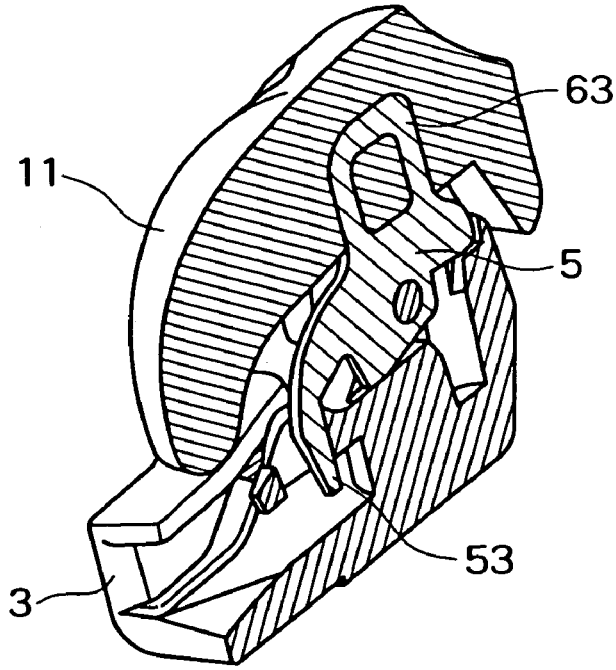
FIG. 7 is a section through a second embodiment of the invention.

FIG. 7 is a section through a second embodiment of the invention. The slider body 3 is identical to the slider body 3 of FIG. 1 and the locking lever 5 is urged by a spring 7 into the fastener element guide channel 39 in the same manner as the locking lever 5 of the slider I of FIG. 1. The main difference between these two embodiments is the manner in which the knob 11 is attached to the locking lever 5.

In this embodiment there is a lug 63 formed on the locking lever 5, the lug 63 extending away from the slider body 3. The knob 11 is fixed to the lug 63 of the locking lever 5 by forming the knob 11 directly onto the lug 63, for example by insert moulding the knob 11 from a thermoplastic material. The knob 11 is pulled backwards to withdraw the locking pawl 53 from the fastener element guide channel 39, allowing the slider 1 to move along the slide fastener to open the slide fastener.

The slider body 3, locking lever 5, spring 7, connecting ring 9 and locking pin 13 are made of metal and the knob 11 is made of a plastic, although different materials may be used to make these components, e.g. the body may be made of plastic.

Conclusion, ramifications, and scope of the invention;

Therefore, in a slider for a slide fastener according to this invention, the slider is moved by means of a decorative knob which is interchangeable by a user with knobs of different designs.

Furthermore, in an automatic slider for a slide fastener according to this invention, the slider is propelled by means of a decorative knob such that when the knob is moved along a slide fastener in either direction the locking mechanism on the slider automatically disengages from the slide fastener.

The present invention has been described above by way of example, and modifications can be made within the scope of the invention.

What is claimed is:

1. An automatic lock slider for a slide fastener, the slider comprising:

a slider body having a fastener element guide channel;

a locking lever pivotally mounted on the slider body, the locking lever having a locking pawl at one end;

resilient means urging the locking pawl into the fastener element guide channel;

a connecting ring, a portion of which is disposed between the slider body and the locking lever; and a knob mounted on the connecting ring, wherein when the knob is pulled in a first direction a first portion of the knob bears on the slider body so that the connecting ring withdraws the locking pawl from the fastener element guide channel and when the knob is pulled in a second direction a second portion of the knob bears on the slider body so that the connecting ring withdraws the locking pawl from the fastener element guide channel;

wherein the knob is pivotally mounted relative to the locking lever, the slider body has a fastener element guide post; and the knob comprises a cavity to accommodate a portion of the fastener element guide post of the slider body, thereby preventing sideways movement and twisting of the knob relative to the slider body.

2. A slider as claimed in claim 1, wherein the first portion of the knob and the second portion of the knob are on an underside of the knob.

3. A slider as claimed in claim 2, wherein the knob is mounted on the connecting ring at a third portion of the underside of the knob and the first portion of the underside of the knob and the second portion of the underside of the knob are disposed on opposing sides of the third portion of the underside of the knob.

4. A slider as claimed in claim 1, wherein the locking lever is mounted on the guide post.

5. A slider as claimed in claim 1, wherein the knob comprises a slot and a bore which passes through the slot, the slot for receiving the connecting ring and the bore for receiving a locking pin to lock the knob to the connecting ring.

6. A slider as claimed in claim 5, wherein the locking pin is removable.

7. A slider as claimed in claim 5, wherein the locking pin is made of a resilient material.

8. A slider as claimed in claim 1, wherein the resilient means is a spring.

9. A slider as claimed in claim 1, wherein the cavity is defined between two downwardly extending side walls.

10. A slider as claimed in claim 9, wherein the cavity is further defined by a third downwardly extending wall which connects the two side walls.

11. An automatic lock slider for a slide fastener, the slider comprising:

a slider body having a fastener element guide channel;

a locking lever pivotally mounted on the slider body, the locking lever having a locking pawl at one end;

resilient means urging the locking pawl into the fastener element guide channel;

a connecting ring, a portion of which is disposed between the slider body and the locking lever; and a knob mounted on the connecting ring, wherein when the knob is pulled in a first direction a first portion of the knob bears on the slider body so that the connecting ring withdraws the locking pawl from the fastener element guide channel and when the knob is pulled in a second direction a second portion of the knob bears on the slider body so that the connecting ring withdraws the locking pawl from the fastener element guide channel;

wherein the knob comprises a slot and a bore which passes through the slot, the slot for receiving to connecting ring and the bore for receiving a locking pin to lock the knob to the connecting ring.

12. A slider as claimed in claim 11, wherein the first portion of the knob and the second portion of the knob are on an underside of the knob.

13. A slider as claimed in claim 12, wherein the knob is mounted on the connecting ring at a third portion of the underside of the knob and the first portion of the underside of the knob and the second portion of the underside of the knob are disposed on opposing sides of the third portion of the underside of the knob.

14. A slider as claimed in claim 11, wherein the slider body comprises a guide post on which the locking lever is mounted.

15. A slider as claimed in claim 11, wherein the locking pin is removable.

16. A slider as claimed in claim 11, wherein the locking pin is made of a resilient material.

17. A slider as claimed in claim 11, wherein the resilient means is a spring.

18. A slider as claimed in claim 11, wherein the slider body has a fastener element guide post; and the knob comprises a cavity to accommodate a portion of the fastener element guide post of the slider body, thereby preventing sideways movement and twisting of the knob relative to the slider body.

19. A slider as claimed in claim 18, wherein the cavity is defined between two downwardly extending side walls.

20. A slider as claimed in claim 19, wherein the cavity is further defined by a third downwardly extending wall which connects the two side walls.

* * * * *